US006276529B1

(12) United States Patent
Feehan, Jr.

(10) Patent No.: US 6,276,529 B1
(45) Date of Patent: Aug. 21, 2001

(54) PACKAGING UNIT FOR ARTICLES WITH CONVENIENT OPENING STRIP

(75) Inventor: Arthur J. Feehan, Jr., Lunenburg, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/505,751

(22) Filed: Feb. 16, 2000

(51) Int. Cl.[7] ..... B65D 73/00

(52) U.S. Cl. ..... 206/469; 206/352; 206/471

(58) Field of Search ..... 206/467, 469, 206/470, 471, 461, 352, 354, 806; 53/453, 412, 133.8; 383/203, 204, 207, 209; 229/87.05, 927

(56) References Cited

U.S. PATENT DOCUMENTS

| | | | | |
|---|---|---|---|---|
| D. 253,040 | | 10/1979 | Fournier et al. | D9/192 |
| D. 253,167 | | 10/1979 | Fournier et al. | D9/185 |
| D. 352,236 | | 11/1994 | Althaus | D9/415 |
| D. 407,851 | | 4/1999 | Shurtleff | D28/48 |
| D. 415,315 | | 10/1999 | Swanson et al. | D28/47 |
| 3,428,171 | | 2/1969 | Blish . | |
| 3,707,040 | | 12/1972 | Lehmann . | |
| 3,933,245 | | 1/1976 | Mullen | 206/498 |
| 3,937,323 | * | 2/1976 | Sagi et al. | 229/927 X |
| 3,970,194 | | 7/1976 | Iten | 206/228 |
| 3,972,417 | | 8/1976 | Iten et al. | 206/354 |
| 4,095,691 | | 6/1978 | Iten | 206/354 |
| 4,240,552 | | 12/1980 | Brown | 206/459 |
| 5,082,112 | | 1/1992 | Dunklee | 206/363 |
| 5,144,942 | | 9/1992 | Decarie et al. | 128/4 |
| 5,209,354 | | 5/1993 | Thornhill et al. . | |
| 5,307,934 | | 5/1994 | Hagner | 206/471 |
| 5,380,094 | * | 1/1995 | Schmidt et al. | 383/209 |
| 5,407,066 | | 4/1995 | Grange | 206/228 |
| 5,411,202 | * | 5/1995 | Fenini | 224/87.05 |
| 5,429,241 | | 7/1995 | Althaus | 206/471 |
| 5,443,154 | * | 8/1995 | Hustad et al. | 383/209 X |
| 5,613,349 | * | 3/1997 | Brown | 53/453 |
| 6,053,318 | * | 4/2000 | Petterson | 229/87.05 X |

FOREIGN PATENT DOCUMENTS

| | | |
|---|---|---|
| 0 452 052 A1 | 10/1991 | (EP) . |
| 2 334 273 | 7/1977 | (FR) . |
| 2 410 611 | 8/1979 | (FR) . |
| 1 580 791 | 12/1980 | (GB) . |
| 2 278 103 | 11/1994 | (GB) . |

* cited by examiner

*Primary Examiner*—Luan K. Bui
(74) *Attorney, Agent, or Firm*—Edward S. Podszus

(57) ABSTRACT

Easy opening blister-type packaging unit (1) having upper and lower walls (2, 2') and a convenient tear-open strip (5, 6, 7) inward of a peripheral seal (4) joining the walls to one another, and method of separating the seal from the blister pack to access a stored article, such as a razor set (16). Packaging unit (1) has upper and lower walls sealed together at peripheral joint (4) and has inward thereof a weakened region (5) formed through preferably both upper and lower walls, defining an opening strip (7). In preferred embodiments the upper and lower walls are semi-rigid plastic panels heat welded together along a periphery and perforated (6) adjacent the weld. To easily access the stored article, the user ruptures the weakened region, tears the opening strip away from the packaging unit to cause the upper and lower plastic material walls to separate. The pack can open like a clam-shell about a hinge (11) formed by second peripheral joint (9) and/or stepped portions (10) on a side opposite the tear strip.

56 Claims, 15 Drawing Sheets

PACKAGING UNIT FOR ARTICLES WITH CONVENIENT OPENING STRIP

BACKGROUND OF THE INVENTION

The invention relates to a semi-rigid blister packaging unit for articles such as razors, articles of personal use and the like.

Conventionally, packaging units for articles, also known as blister packs, are made from two (upper and lower) plastic material walls or foils. These walls are relatively stiff synthetic sheets, with a heat seal weld along the major peripheral edges or indeed surrounding the entire periphery. Representative of these are packs shown in U.S. Pat. No. 5,429,241 (Althaus); U.S. Pat. No. 5,407,066 (Grange) and U.S. Design Pat. No. 352,236 (Althaus). Blister packs are also known to have a plastic blister front and a cardboard rear wall, the plastic front being glued lo the cardboard, which is opened when the user peels the two halves away from one another, or pulls back a perforated flap or panel on the cardboard back wall. Representative of these are packs shown in U.S. Pat. No. 4,095,691 (Iten); U.S. Pat. No. 3,972,417 (Iten et al.); U.S. Pat. No. 3,970,194 (Iten); U.S. Pat. No. 3,933,245 (Mullen); and U.S. Designs Pat. No. 253,167 (Fournier et al.) and U.S. Pat. No. 253,040 (Fournier et al.).

Other packs are known in U.S. Pat. No. 5,307,934 (Hagner); U.S. Pat. No. 5,144,942 (Decarie et al.); U.S. Pat. No. 5,082,112 (Dunklee); U.S. Pat. No. 4,240,552 (Brown); European Patent Application EP 452 052 A (Oscar Meyer Foods Corp.); French Patent 2 334 273 (Carl M. Spielware KG); and French Application 2 410 611 (General Foods).

Applicant has recognized that various disadvantages of these known blister packs include they are frequently difficult to open, usually requiring scissors or considerable force, or do not allow easy access to the article within, which is inconvenient for the user.

APPLICANT'S ACKNOWLEDGED PRIOR ART

Another type of known blister pack, sold by The Gillette Company to package the razor and its holder tray and cartridge dispenser packaged as a unit and sold under the trade designation Mach3 in the United States and elsewhere, is illustrated in the accompanying FIGS. 1–6 labeled "prior art." This pack (100) is formed of two semi-rigid plastic panels with a heat-sealed weld around the entire periphery and includes a perforated section (101) on the rear panel inward of the heat-sealed weld. The upper panel has a pouch to receive the razor set. The perforated section is only on the rear panel, and defines a perforated access or fold-out back flap (101) that hinges at the bottom (102). The perforations are only on the rear wall of the two plastic walls, and do not extend near to the top peripheral edge of the blister pack, but meet in the center of the rear panel where the user must insert a thumb and finger near the rectangular indented grip region to begin prying back the access flap. There are interlocking stepped portions formed in the upper and lower plastic material walls inward of and adjacent the heat-seal joint, extending around the periphery of the pack. This aids in forming the hinge at the bottom of the blister pack, when the consumer pulls back the perforated access flap. The blister pack also has one printed cardboard informational insert (103), which is held between the lower plastic material wall and the enclosed article. The cardboard insert is generally coincident with the extent of the rear wall and lies under the entire razor set. The cardboard insert has a perforated region extending transversely across its width, dividing it into a major lower portion (103*b*) and a minor upper portion (103*a*). After the user pulls back the rear access flap (101), the user tears the cardboard insert's perforations and pries out the loDwer portion (103*b*) of the cardboard insert, leaving the smaller portion (103*a*) retained between the upper and lower walls of the pack. The razor set is removed by passing it out the opening created by the user having both bent back the rear access panel (101) and lifted out most of the cardboard insert (103). While this package has been successfully used, Applicant herein has determined that an even more convenient opening pack can be provided.

SUMMARY OF THE INVENTION

The invention provides a packaging unit for articles featuring a convenient opening strip that provides easy access to the article enclosed within the packaging unit, which the inventor has determined is understood intuitively by the user how to open.

In one aspect, the invention features, in general, a packaging unit for articles, comprised of two spaced-apart upper and lower walls of material that have been formed to define an article-receiving region between them. The material walls, at least one of which is of plastic, are sealed together at a first peripheral joint, having along and inward of the peripheral joint, a weakened region formed through both of the walls. The weakened region is rupturable by a user, by applying manual force, allowing for the first peripheral joint to be separated from the upper and lower material walls, thereby enabling access to the article-receiving region. Preferably, both upper and lower walls are plastic. Preferably at least one, and more preferably both, of the two walls are made of semi-rigid material. Preferably, the weakened region is formed by perforations scored into the walls and inboard of a heat seal.

In another aspect, the invention features a method of conveniently opening a sealed packaging unit which has been provided with a weakened region inward of the sealing joint, and detaching the weakened region from the packaging unit in order to separate the walls.

In a further aspect, the invention features, in general, a packaging unit comprising a second peripheral joint on a marginal edge laterally opposite the first peripheral joint; and stepped portions formed in the plastic material wall, along some or all the peripheral edges of the packaging unit. The second peripheral joint and interlocking stepped portions each help form a hinge about which the upper and lower plastic material walls separate like a clam shell when the opposite weakened region is ruptured by a user.

Preferred embodiments of the invention may include one or more of the following features. In a preferred embodiment, the weakened region is comprised of perforations and extends adjacent the first peripheral joint and towards at least one adjacent marginal edge of the packaging unit. In another preferred embodiment, the packaging unit comprising a first and a second product informational insert disposed within the article-receiving region above and below the received article. These inserts carry information relating to the article contained within the packaging unit.

Embodiments of the invention may include one or more of the following advantages. The packaging unit of the present invention has a perforated weakened region that provides a convenient opening strip. The rupturing of the weakened region allows for the convenient opening strip to be torn away from, or even completely separated or detached from, the packaging unit, causing the upper and lower plastic material walls to separate, thereby facilitating easy access to the article contained within the article-receiving region of the packaging unit.

In a further aspect, the invention features a semi-rigid plastic material wall having a weakened region, which may be formed by scoring, and sealed to the other wall which is formed of a material which itself is not tear-resistant so that a separate weakened region is omitted in the this wall, the opening force being directed along the opening strip to tear both plies of the packaging unit and thus separate the joint.

Other advantages and features of the invention will be apparent from the detailed description of its particular embodiments, the figures and from the claims.

DETAILED DESCRIPTION OF PREFERRED EMBODIMENTS

Figure 1:
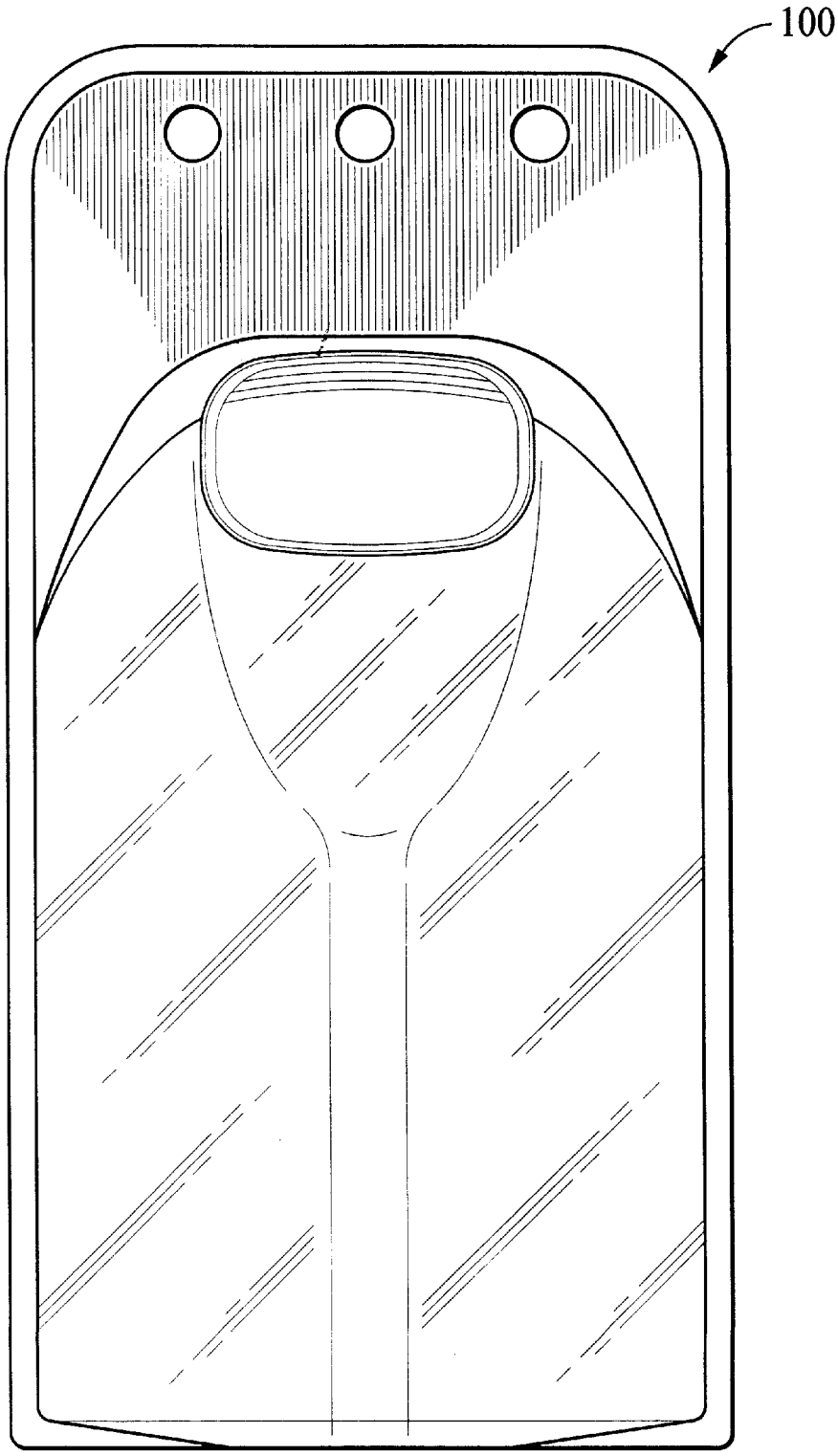
FIG. 1 (Prior Art)
FIG. 1 is a front view of a prior art blister pack sold under the trade designation "Mach3"
Figure 2:
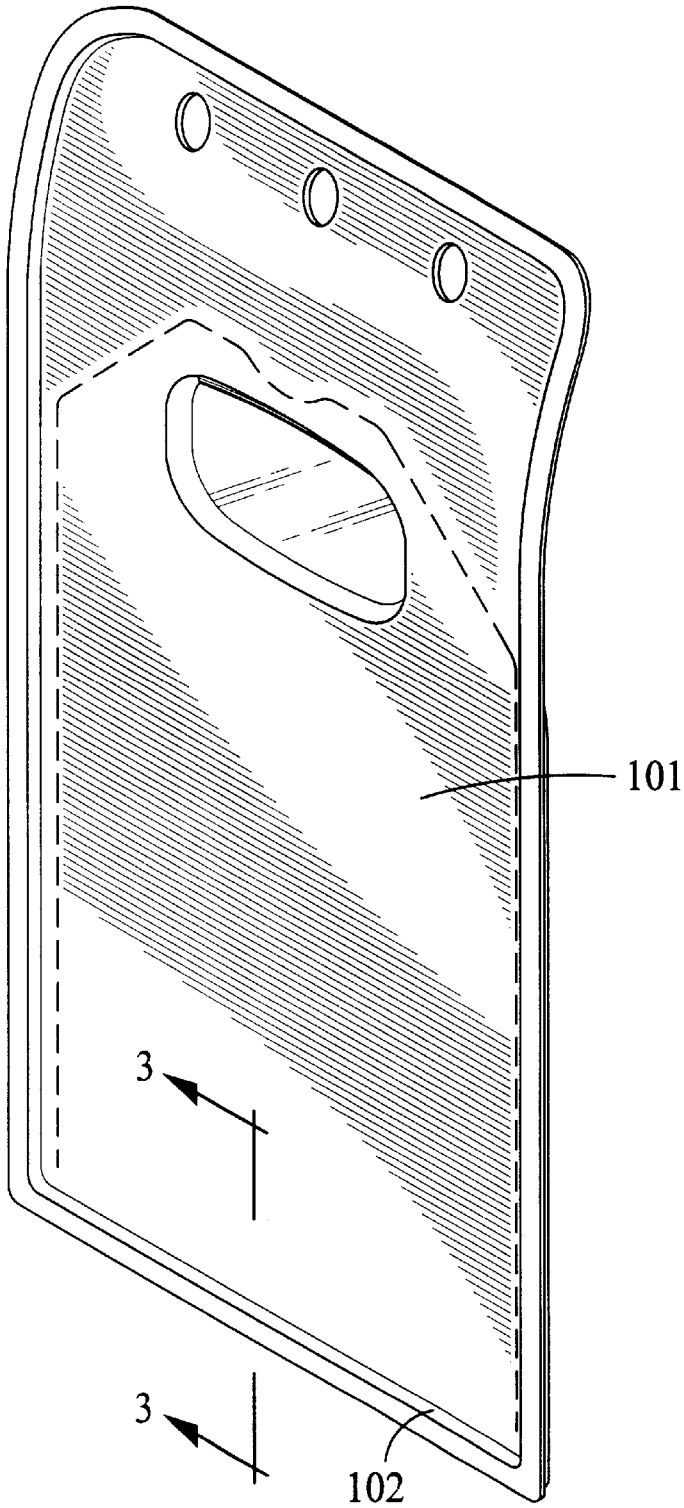
FIG. 2 (Prior Art)
FIG. 2 is a rear isometric view of the pack of FIG. 1, showing the perforated back panel thereof.
Figure 3:
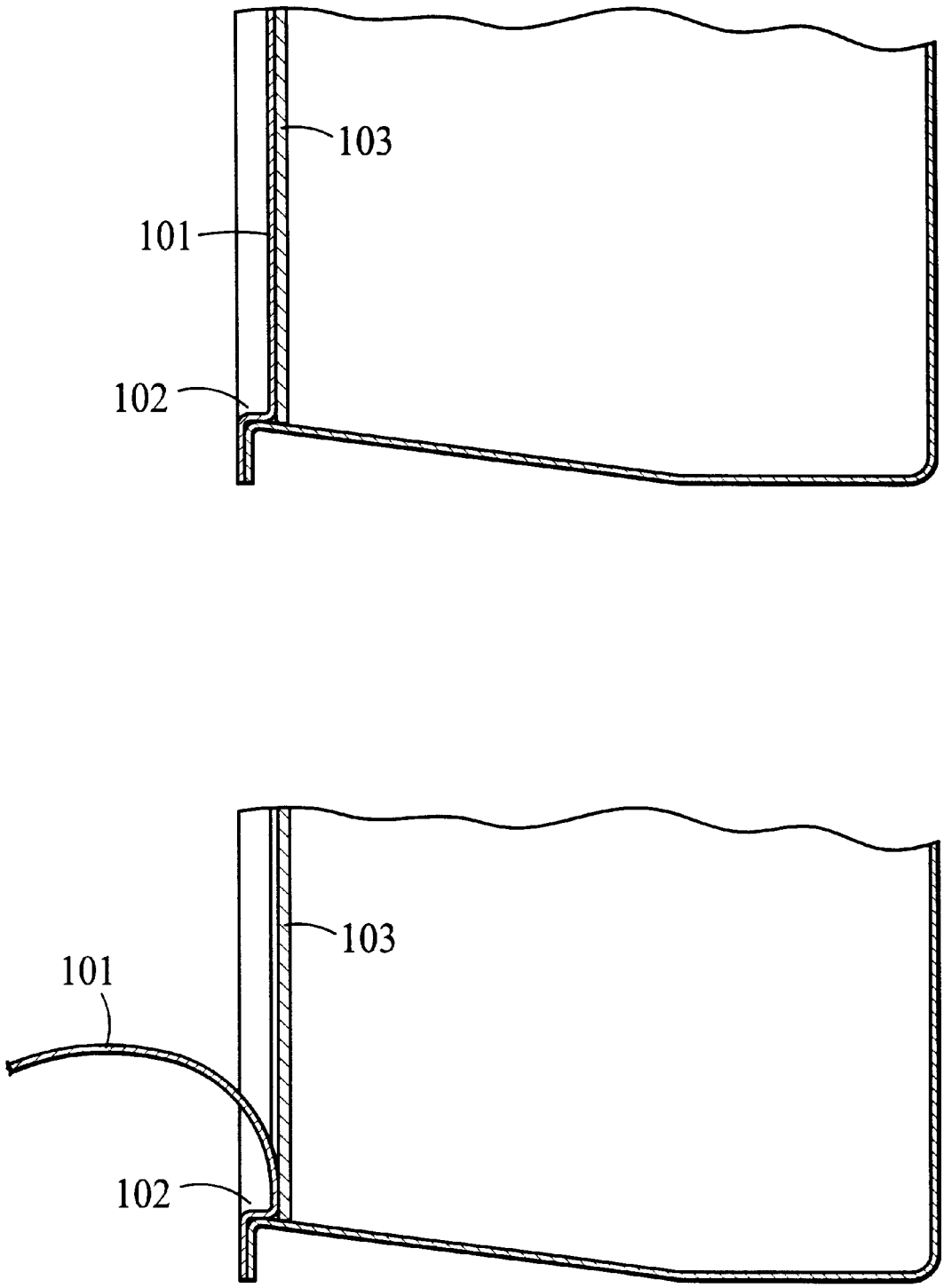
FIG. 3 (Prior Art)
FIG. 3 is an enlarged cross-sectional view taken along section line 3—3 of FIG. 2, showing the rear access panel peeled back.
Figure 4:
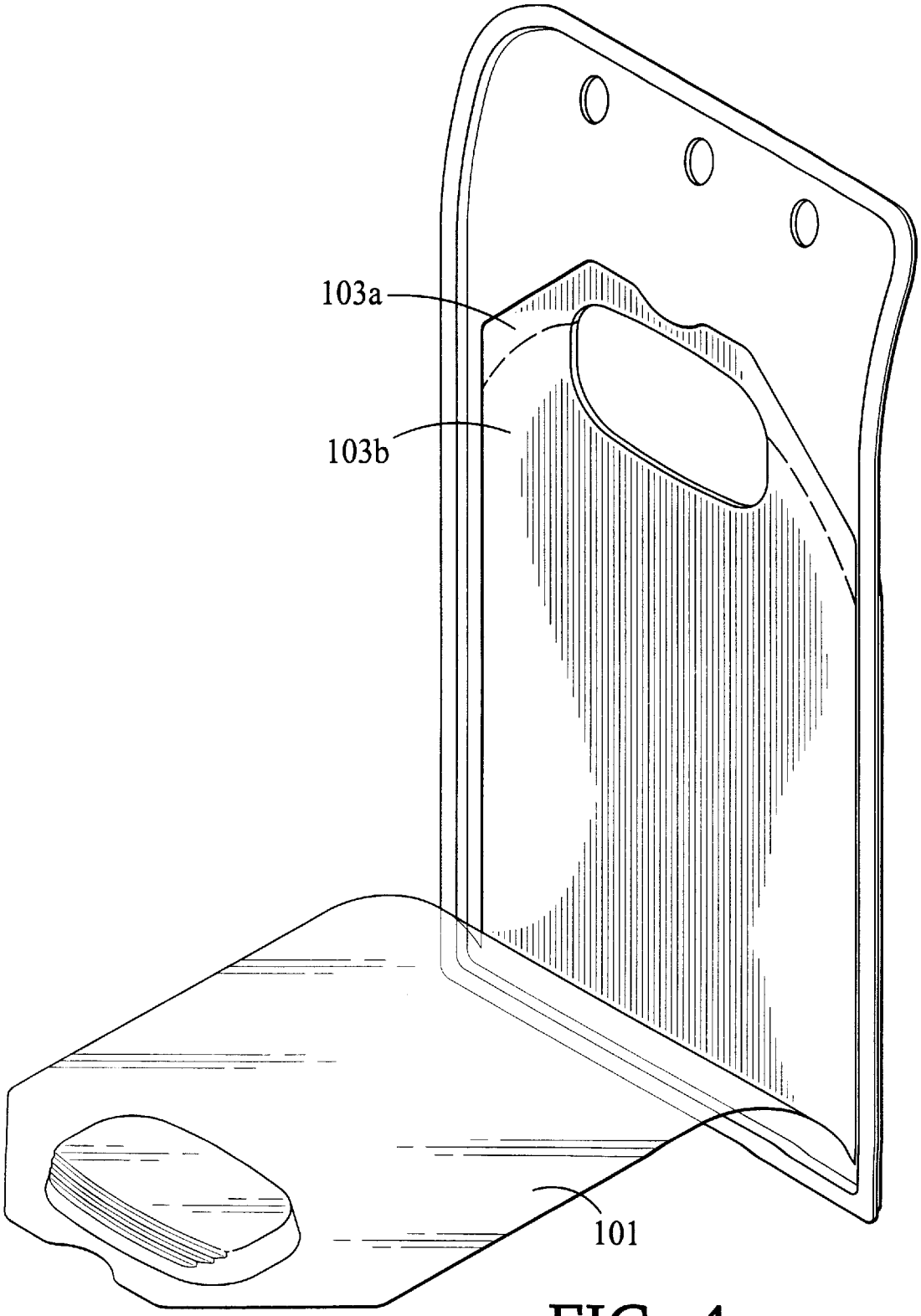
FIG. 4 (Prior Art)
FIG. 4 is an isometric view of the rear panel of the pack of FIG. 1 peeled back.
Figure 5:
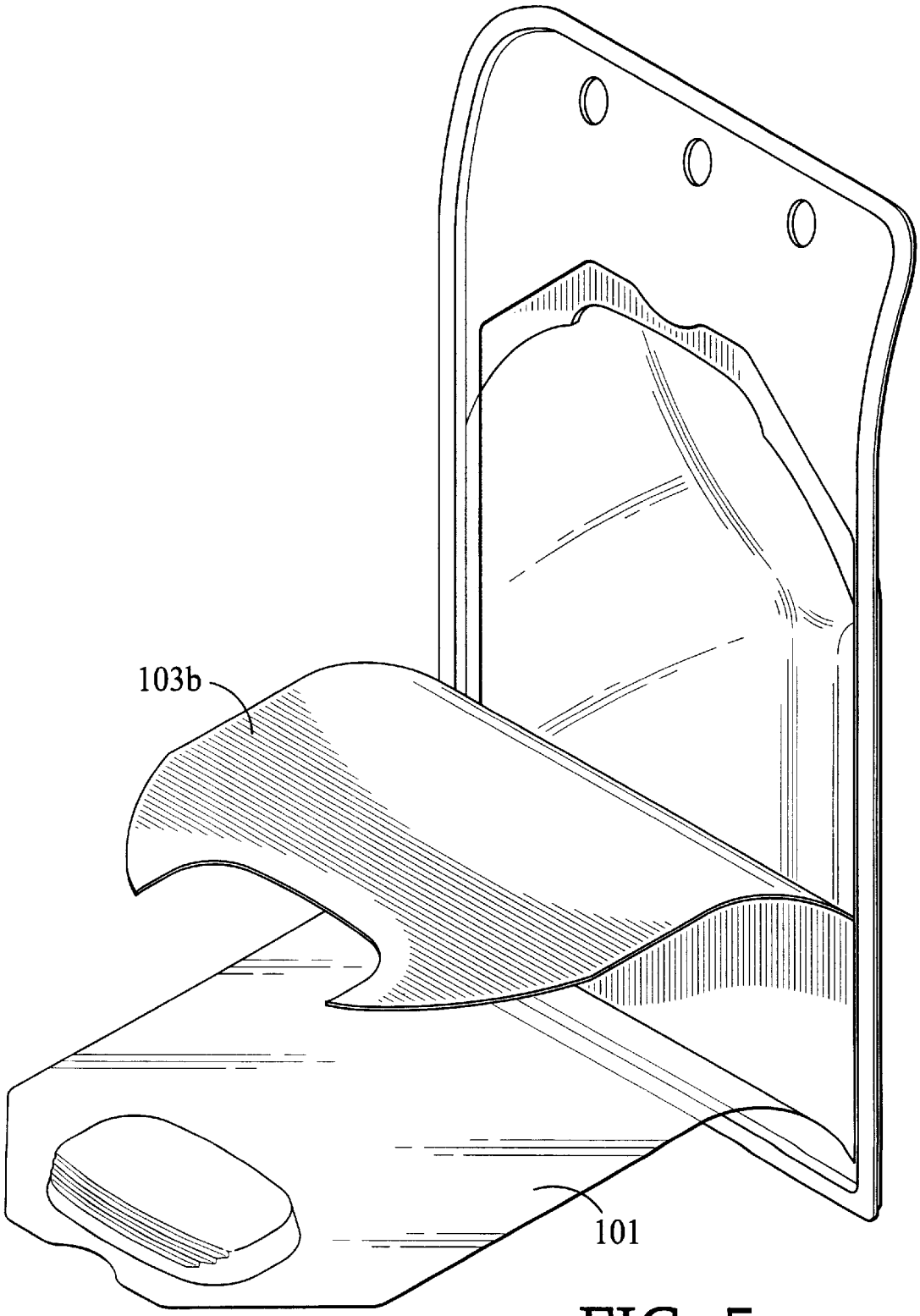
FIG. 5 (Prior Art)
FIG. 5 is an isometric view of the rear panel and information insert of the pack of FIG. 1 peeled back.
Figure 6:
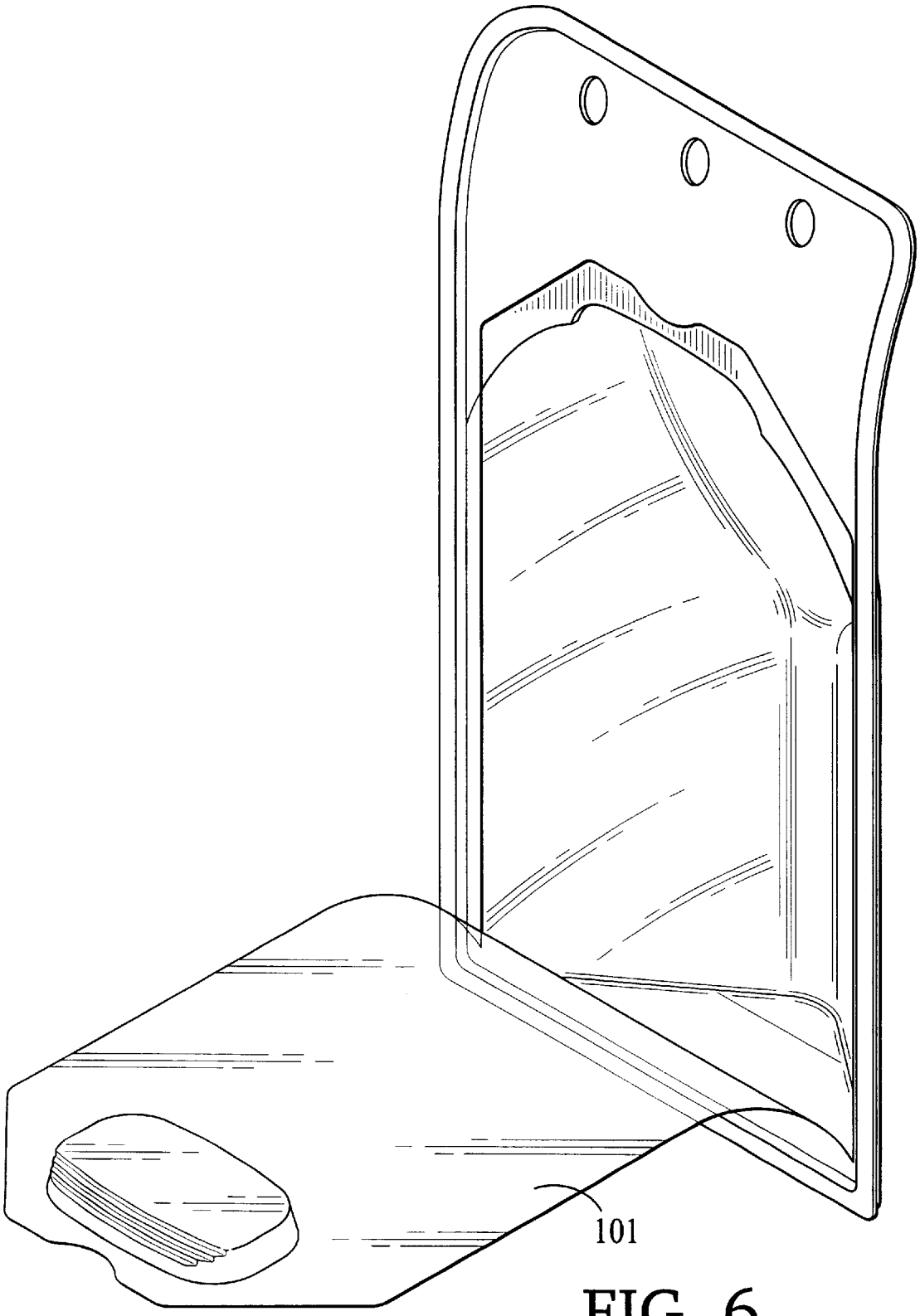
FIG. 6 (Prior Art)
FIG. 6 is an isometric view of the rear panel of the pack of FIG. 1 peeled back, with the cardboard information insert removed.
Figure 7:
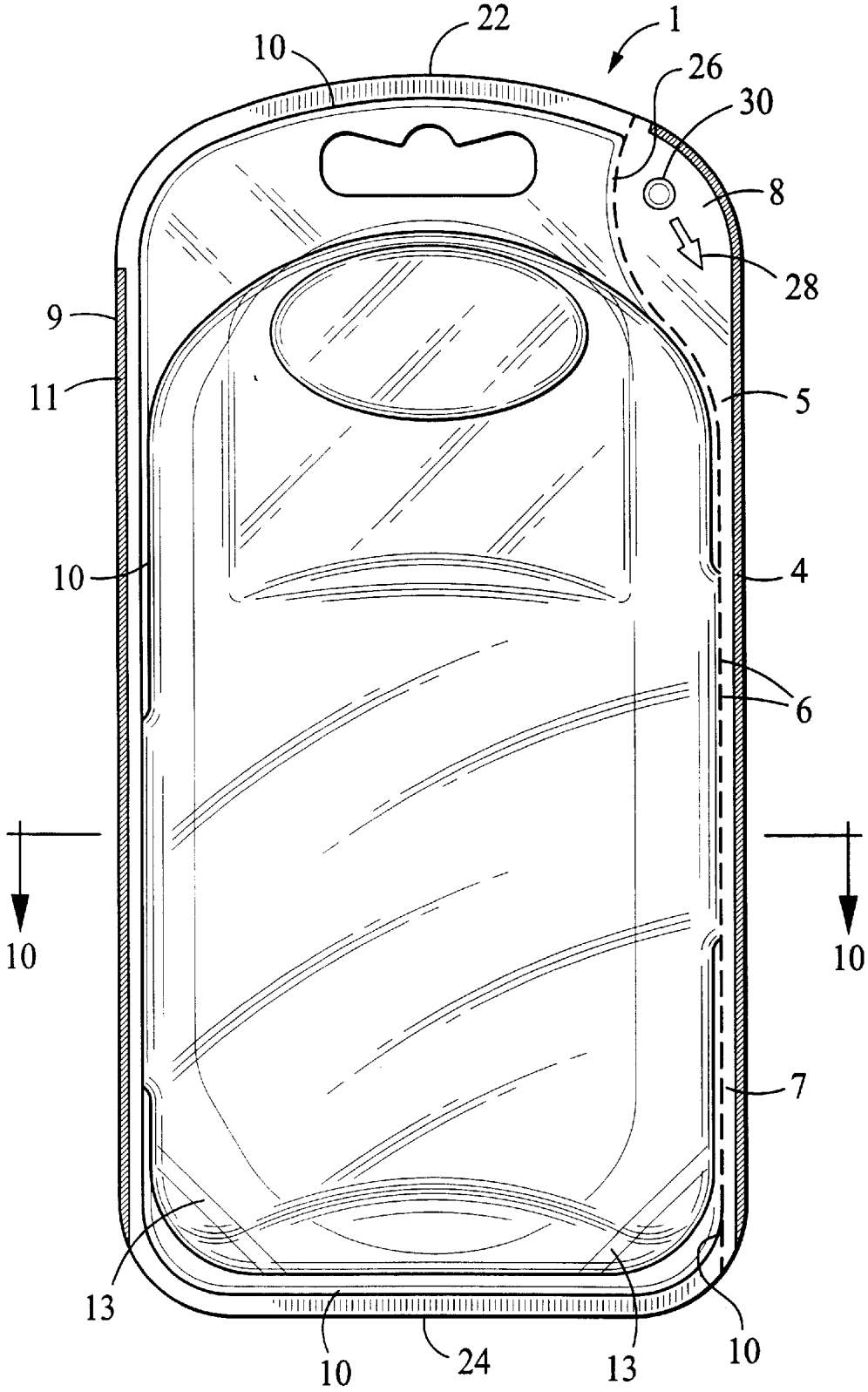
FIG. 7 is a front view of the packaging unit of the present invention, with a convenient opening strip.
Figure 8:
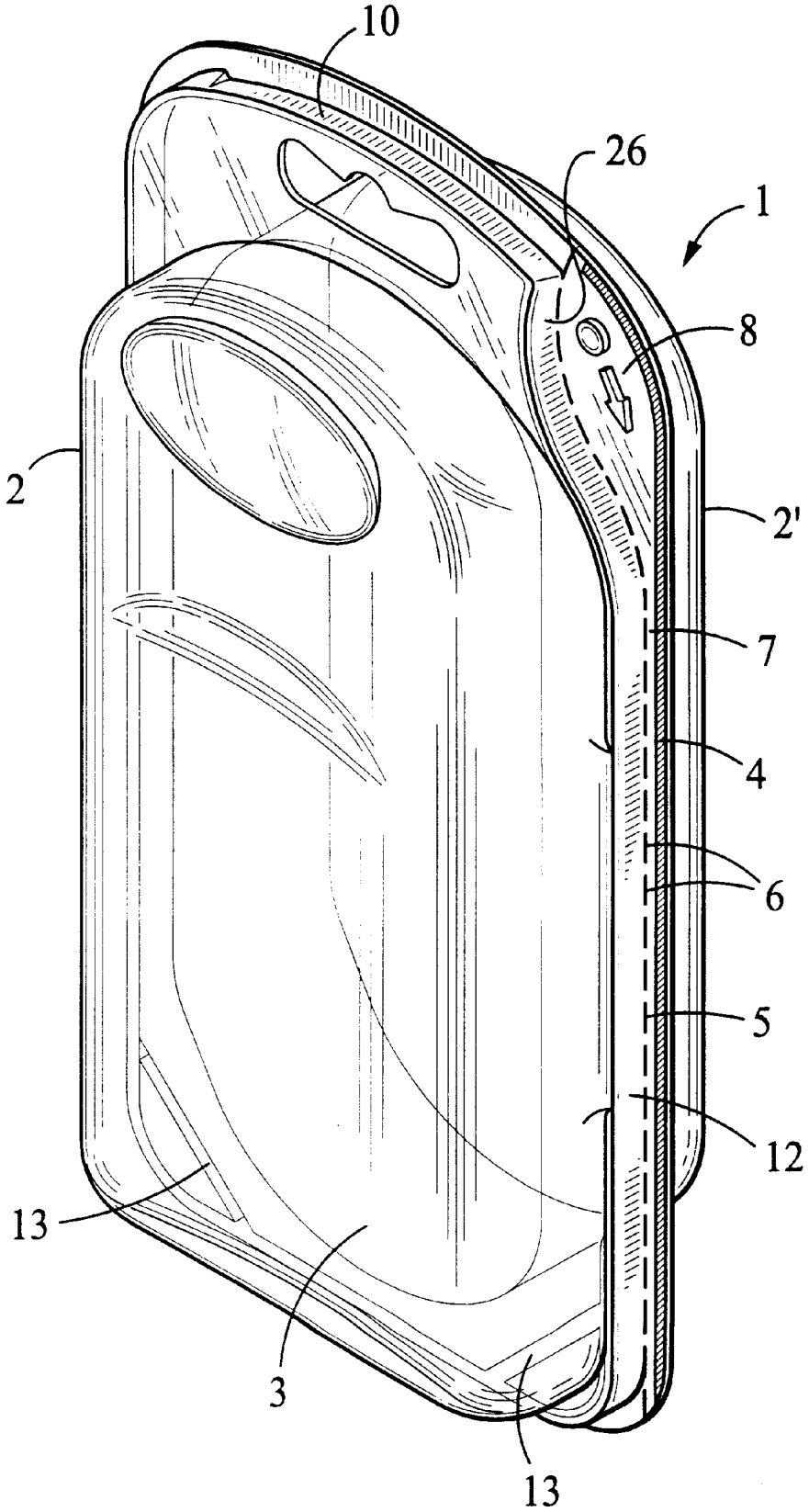
FIG. 8 is an isometric view of the packaging unit of FIG. 7.
Figure 9:
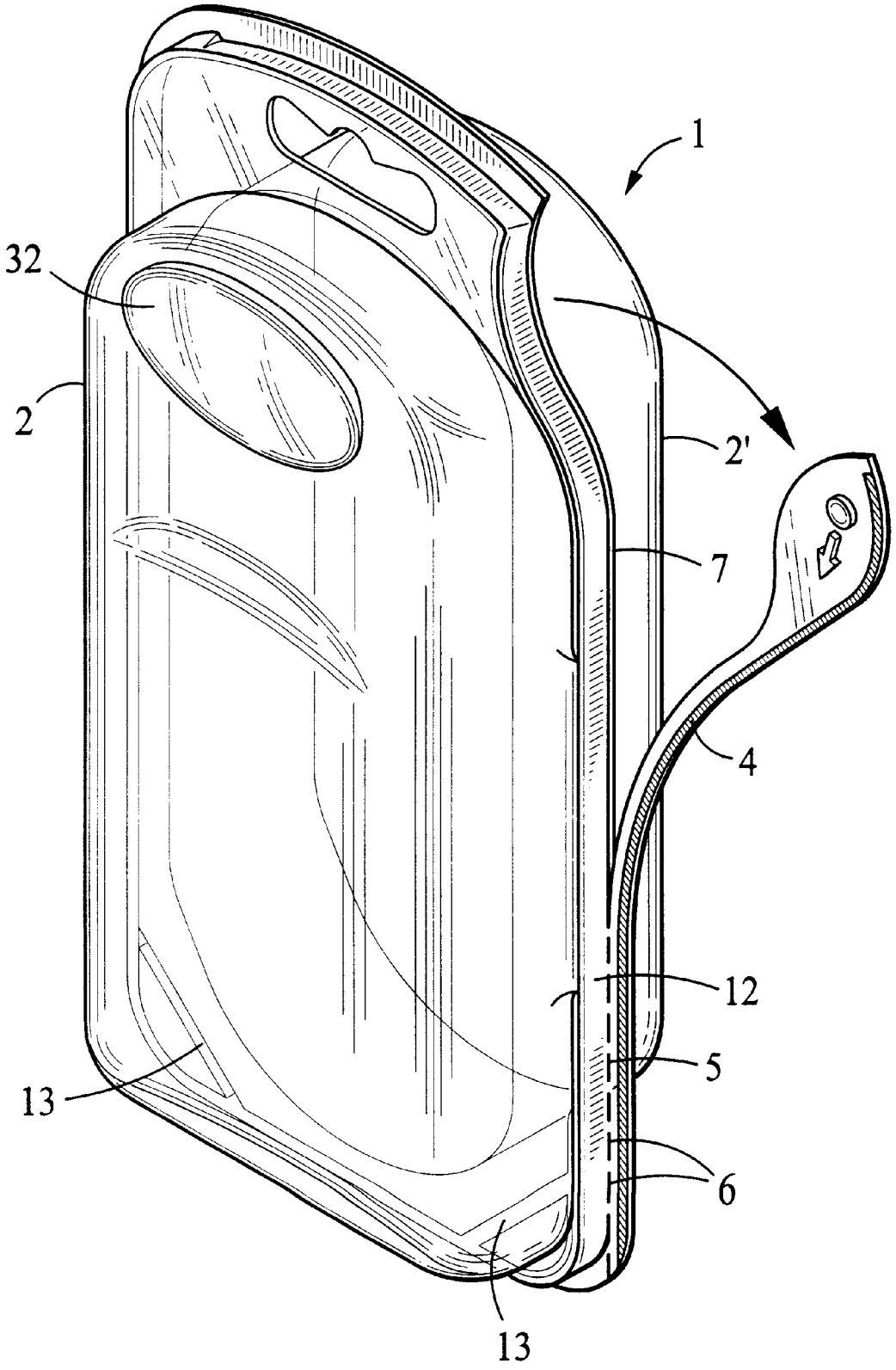
FIG. 9 is an isometric view of the packaging unit of FIG. 7, showing the convenient opening strip being removed.

Referring to FIGS. 7 through 16, there is shown a packaging unit 1 for articles. Referring to FIGS. 7–9, the packaging unit 1 is comprised of two spaced-apart upper 2 and lower 2' walls that have been formed to define an article-receiving region 3 between them commonly referred to as a blister, pouch, pocket or cavity. The wall can be referred to as a sheet, foil or panel. The article-receiving pouch shape can be formed into one wall and the other be flat, but it is preferred that both walls define parts of the article-receiving pouch. The packaging unit 1 may have a plurality of shapes, including rectangular, circular or oval; preferably, in general, having a rectangular shape. Preferably at least one wall, preferably upper wall 2, is formed of semi-rigid material, which generally retains a shape, e.g. the blister shape, into which it is formed, and is relatively stiff. Preferably at least one of the walls, preferably upper wall 2, is formed of plastic material, preferably transparent plastic, to correspond at least generally, or could even closely conform, to the shape of the retained article and permit viewing it prior to purchase. Preferably, both upper 2 and lower 2' walls are made of plastic. More preferably, both upper 2 and lower 2' walls are made of semi-rigid material, and most preferably that material is of plastic, in particular transparent. Alternatively, though less preferred, one of the walls, such as the lower 2' wall, can be formed as a flexible sheet, such as plastic film, including polyethylene or polypropylene film.

The semi-rigid plastic material walls 2, 2' can be thermally formed from plastic materials, preferably polyester materials. Suitable materials also include, without limitation, PVC and PET G (extra glycol polyester). In the case of walls 2, 2' being made of plastic, suitable forming techniques include vacuum forming and deep drawing, whereby a sheet of material is drawn down with the assistance of pressure over an aluminum tool corresponding in shape to the article-receiving region 3 to be formed, then cooled and set. Alternatively, although presently less preferred, one wall could be made of plastic and another wall of cardboard, paperboard, spun-bonded synthetic fibers such as polyolefin or Tyvek (a registered trademark of DuPont), or other fibrous material. In the case of a wall, such as lower 2' wall, being generally unformed or flat, thus requiring a minimum of processing, it may economically be formed using a flat sheet of plastic, a flexible film or a fibrous material. The use of an all-plastic packaging unit has the advantage that it is easily recyclable without having to separate dissimilar materials, is strong and provides a good opportunity to view the contained article. It is understood that the materials can be chosen with regard to the weight of the article to be packed therein, the desired resistance to package crushing or deformation, material cost, and environmental matters such as ease of recycling a package made of a homogenous material rather than dissimilar materials.

Figure 12:
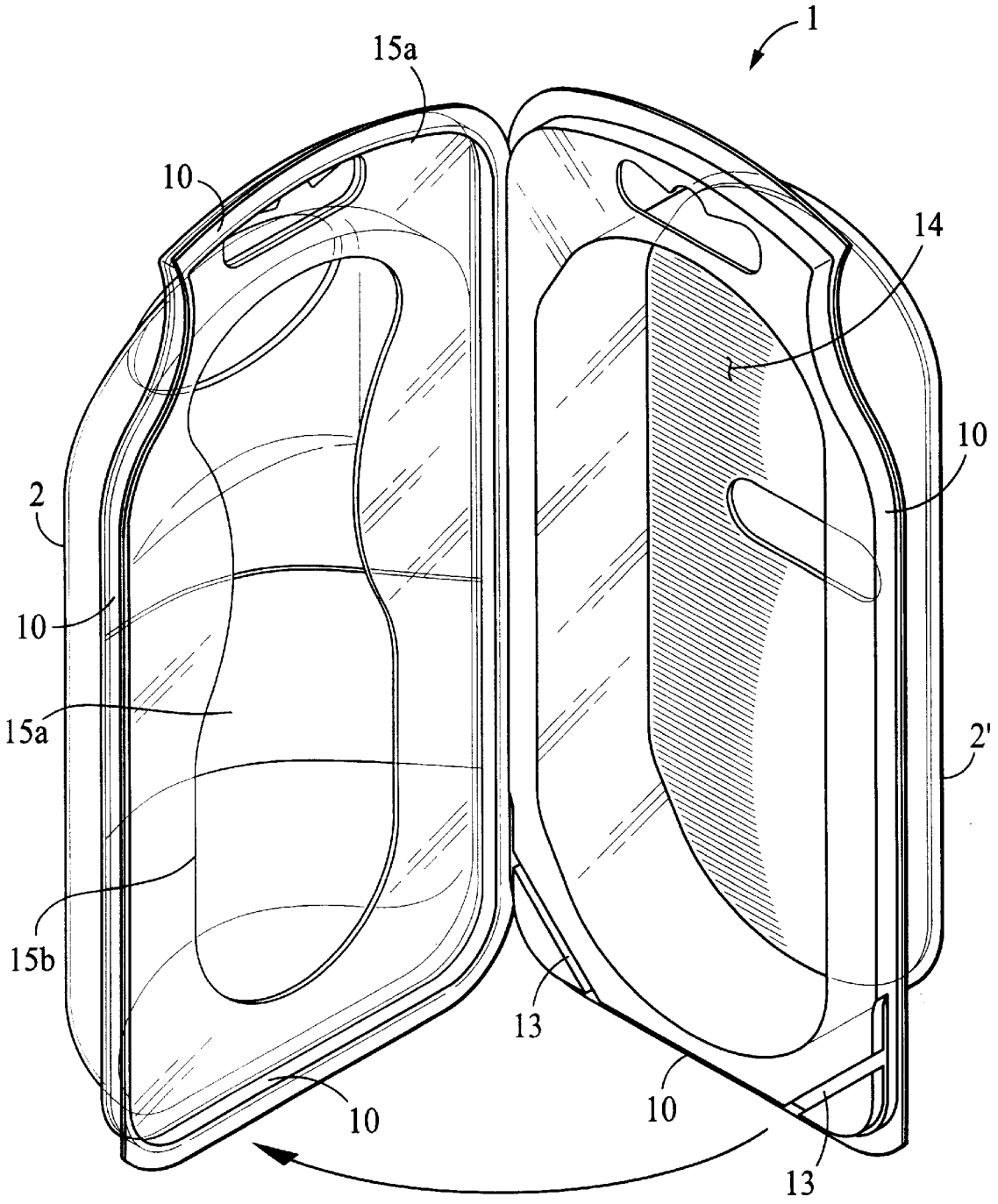
FIG. 12 is an isometric view of the packaging unit of FIG. 7, showing the convenient opening strip fully detached and the packaging unit opened about its hinge.
Figure 13:
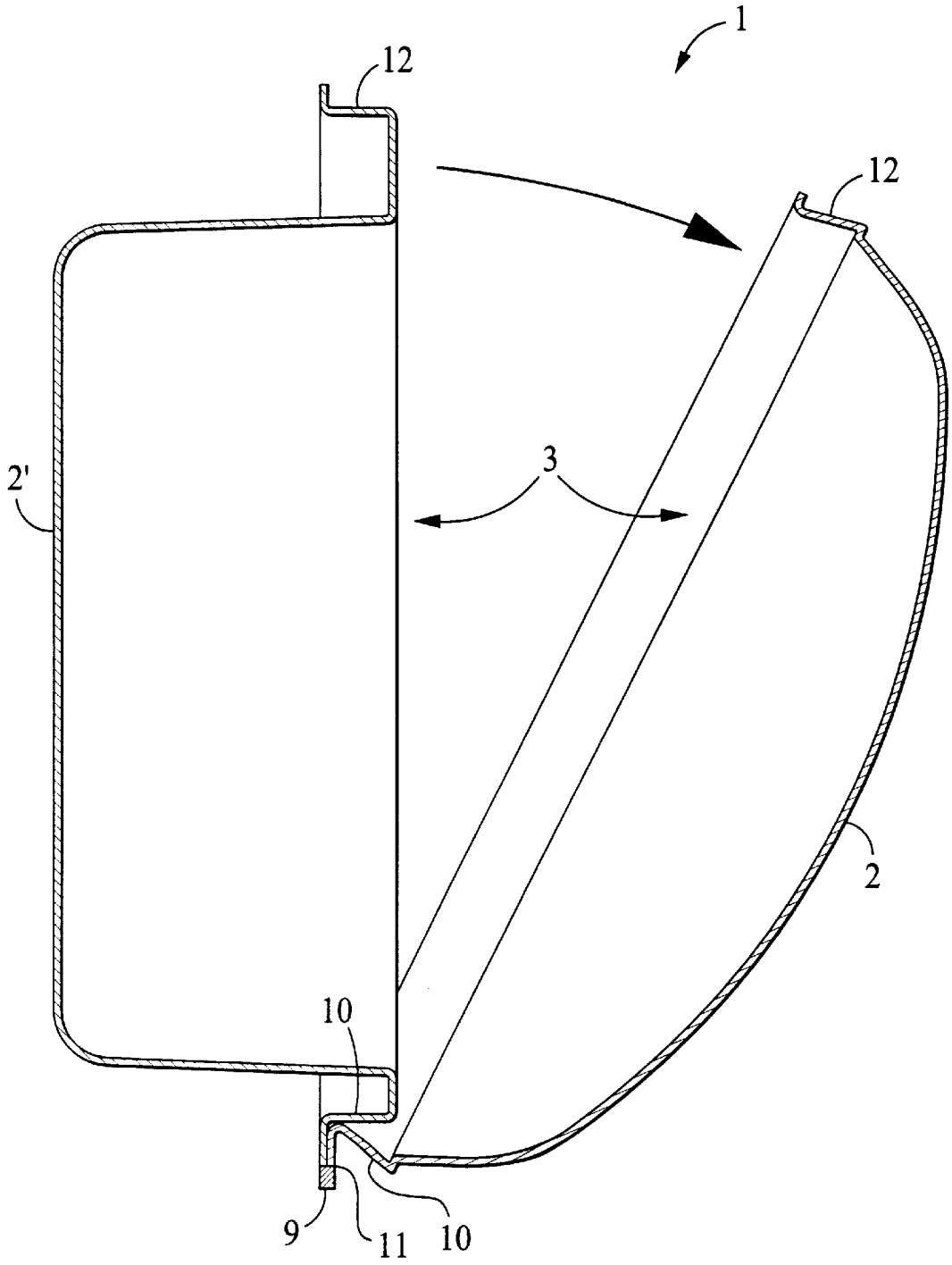
FIG. 13 is a cross-sectional view of an opened packaging unit of FIG. 7 along a location corresponding to line 10—10 of FIG. 7.

Referring to FIG. 7–9, the packaging unit 1 is sealed along at least a first peripheral joint 4 (on the package's right side in FIG. 7). The packaging unit 1 may be sealed around all peripheral edges; however, it is preferred, in general. that it is sealed along two laterally opposite peripheral edges in the regions shown at 4, 9, but not sealed at the adjacent sides, which are the pair of opposite top 22 and bottom 24 edges. The plastic material walls 2, 2' are sealed together at a first peripheral joint 4. The packaging unit 1 can have a second peripheral joint 9 (left side in FIG. 7) on a marginal edge laterally opposite the first peripheral joint 4. The peripheral heat-seal joints 4, 9 extend along substantially the extent of their respective edges. The second peripheral joint 9 forms a hinge 11 about which the plastic material walls 2, 2' separate when the convenient opening strip 7 is torn away, thereby facilitating access to the article-receiving region 3 of the packaging unit 1 as shown in FIGS. 12–13. The separation of the upper and lower walls is facilitated by the top 22 and bottom 24 edges not being sealed. It is convenient that the second peripheral joint 9 can be formed similarly as the first joint 4. It is also possible that upper and lower walls 2, 2' be formed of one sheet of material that has been creased and folded back on itself along the edge opposite the first peripheral joint 4, and to help retain its folded shape, hinge 1I can be heat-formed inward of the side crease, forming a C-shaped hinged joint, as is understood in the art. The sealed assembly overall defines a semi-rigid packaging unit 1 which has a good degree of stiffness to protect article 16 and resists accidental opening.

The joint or joints may be achieved by use of such convenient techniques as adhesives, ultrasonic, heat-sealing, radio-frequency (RF) sealing (also referred to as "high frequency" HF sealing), or firm mechanical interlock. It is preferred that the joint be strong enough such that it is not easily peeled apart (i.e., resists delamination), since it is not necessary for the consumer to separate the layers of the joint itself, but rather the entire joint is to be separated from the remainder of the packaging unit in order to access the stored article. The type of joint chosen depends on the material of which walls 2, 2' are made, as is understood in the art. A heat seal or RF seal is understood in the art to form a firm, "welded" joint in the classes of preferred plastics such as above mentioned, as is commonly used in blister packs and well understood in the art. A suitable RF seal is about 0.10 inch (2.5 mm) wide in plan view as seen in FIG. 7. Adhesives of the isocyanate type would also "weld" these kinds of plastics, although rubber based adhesives are not preferred since they are less resistant to being peeled open. Also alternatively, if one wall were made of plastic and the other of cardboard, a suitable adhesive can form the joint, as is well understood in the art.

Figure 10:
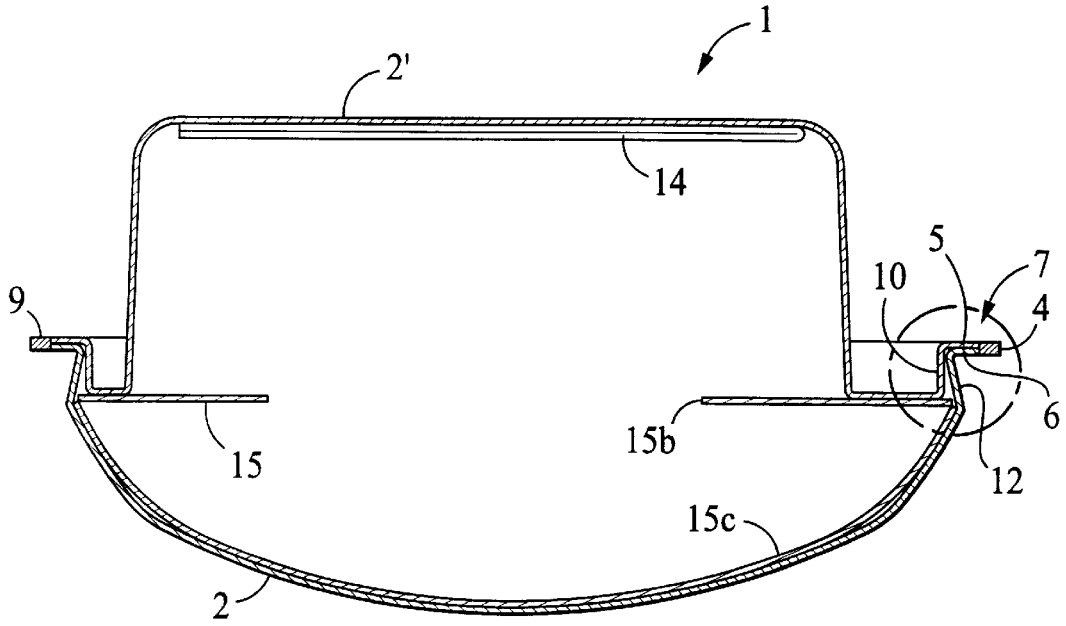
FIG. 10 is a cross-sectional view, taken along section line 10–10 of FIG. 7, showing the convenient opening strip region encircled.
Figure 11:
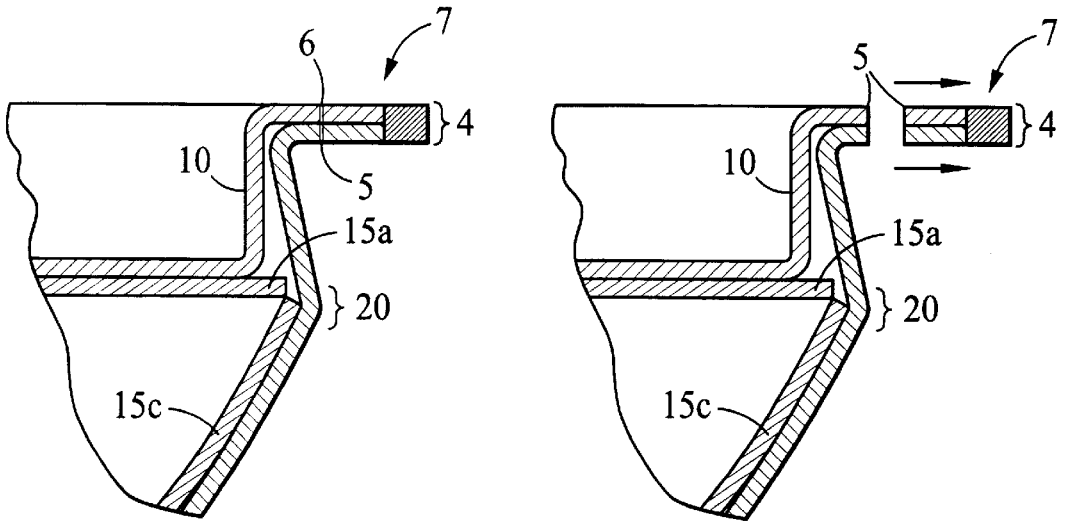
FIG. 11 shows enlarged cross-sectional views of the encircled region of FIG. 10, demonstrating the removal of convenient opening strip.

Referring to FIGS. 9–11, along and inward of the first peripheral joint 4 is a weakened region 5 formed in preferably both plastic material walls 2, 2'. Preferably, the weakened region 5 is approximately parallel and coextensive with the first peripheral joint 4, and formed by perforations 6. Formed from the plastic material walls 2, 2', and defined between the weakened region 5 and the first peripheral joint 4, is a convenient opening strip 7. Thus, the opening strip 7 is inward of the peripheral joint 4 and outward of the article-receiving region 3. When the perforations 6 of the weakened region 5 are ruptured, which can be done upon application of a moderate manual force of, more or less, about 2 pounds (in the range of about 1 kg), the convenient opening strip 7 can be torn away from the packaging unit 1 (see FIGS. 9, 11), allowing for easy access to the article-receiving region 3. The weakened region 5 is especially advantageous when one, or both, walls 2, 2' are formed of semi-rigid material, such as plastic, since the semi-rigid material itself is stiff and not easily torn by a manual force without weakened region 5.

An advantage of the invention has been determined by Applicant to exist in that users intuitively understand to tear opening strip 7 to open the packaging unit, thus eliminating the need for extensive opening instructions to be printed on the package, which permits more of the finite surface area of the package to be available for viewing the article and communicating substantive information about vended article 16 itself.

Referring to FIGS. 7–8, preferably weakened region 5 extends towards at least one edge of the packaging unit 1, as shown in FIG. 7. The closer weakened region 5 extends to an edge, such as a peripheral edge adjacent the edge on which peripheral joint 4 is located, such as top edge 22, generally the easier it is for the user to begin tearing away opening strip 7. The weakened region 5 can, but does not have to, extend all the way to a free edge; it may be desired to stop it short of the exact outer edge in order that it does not start to separate unintended, such as when a purchaser is examining the package or during shipping. The weakened region 5 can also be configured to intersect (extend through) the first peripheral joint 4 towards the edge along which first peripheral joint 4 extends. The weakened region can be torn more easily than the unweakened regions of plastic foils 2, 2', and it will also be appreciated that perforations 6 act to concentrate an applied stress of tearing. It will be understood that the spacing of the weakened region 5 to an edge can be selected to determine the starting force. It is also preferred that the weakened region 5 extends to the bottom edge 24 opposite the start-tearing top edge 22, although this is not necessary; the closer weakened region 5 extends all the way to bottom edge 24, the easier it will be to completely detach opening strip 7 from the packaging unit, as in FIG. 12.

Perforations 6 can be any convenient weakening and/or stress-concentrating features such as made by thermal forming, heat-weakening (e.g., using RF), scoring, or heat-scoring. The perforations 6 can be formed to extend partly through both walls 2, 2', as might conveniently be done with heat-weakening or partial slitting. Depending on the material, as understood in the art 50 percent cuts (slits extending through 50% of the thickness), more or less, could be sufficient. More preferably, perforations 6 are formed to completely extend through both walls 2, 2', such as by scoring fully through the material's thickness, as is presently preferred. Mechanical scoring is suitable for generally thinner materials. It is presently preferred to form the perforations as 10 mm long running slits with 1 mm of un-slit portion ("land") between the slits when using PVC or PET G sheets of about 0.015 inch (0.4 mm) thickness, it being understood that the choice of dimensions would be made by one of skill in the art in light of the thickness and stiffness of the wall material. The perforations 6 can be formed subsequent the formation of the plastic material walls 2, 2'. It is preferred that perforations 6 be done in the blanks for respective walls 2, 2' before the walls are heat-welded together, since then the wall forming step can be done in one operation; otherwise, if the perforations 6 were formed after the walls are heat-welded, that would require an additional processing step. If the packaging unit were heat-sealed around most of or substantially all its circumference, then it will be appreciated that the weakened, perforated region 5, 6 would correspondingly be extended from one edge, around a corner, to another one or more edges, somewhat resembling a zipper around the several sides of a suitcase.

A gripping corner 8 is located at the approximate intersection of two adjacent side edges of the packaging unit 1, on the convenient opening strip 7. Preferably, the weakened region 5 extends adjacent the first peripheral joint 4 towards an adjacent marginal edge of the packaging unit 1 thereby forming the gripping comer 8 allowing for the application of a tearing force on the convenient opening strip 7. Preferably, the gripping corner 8 has an inwardly directed curve shape that forms a thumb indentation 26 for ease of manipulation. Gripping corner 8 may be provided with visual cues to reinforce or suggest a direction for tearing, such as arrow indicia 28 and/or button-shaped location indicia 30 formed in the material, which also enhanced ergonomic gripping.

Referring in particular to FIGS. 10–11, formed into the upper and lower plastic material walls 2, 2' and extending at least along one peripheral edge of the packaging unit 1, are stepped portions 10. Referring to FIGS. 8–9, stepped portions 10 adjacent weakened region 5 form a stiffened rib 12 about which an application of a tearing force may be directed (acting somewhat like a fulcrum), and also help retain upper and lower walls 2, 2' in their relative lateral orientation. It is preferred to have stepped portions 10 in both upper and lower walls 2, 2', forming interlocking stepped portions 10 to provide more rigidity in the rib 12 region. It has been found convenient to have the line of perforations 6 of weakened region 5 parallel to and adjacent, spaced about 0.050 inch (in the range of about 1–2 mm) from, the stepped portions 10. In a further embodiment discussed below, wherein weakened region 5 is formed in only one sheet, for example as perforations 6, but in the other sheet there is no discrete weakened region, rather the material of the other wall being generally a sheet offering little tear-resistance, stepped portions 10 provide a stiffness rib believed to help direct a tearing force to conveniently tear off the opening strip. The use of a stepped portion 10 can be especially helpful if only one sheet, such as upper wall 2, is formed with contours and a stepped portion, and the lower wall 2' is generally flat and unformed, even without stepped portions 10 or a discrete weakened region, so as to provide some stiffening rib effect to direct a tearing force.

Referring to FIGS. 7–8, it is preferred that the stepped portions 10 extend around the periphery of the packaging unit 1. The stepped portion of the lower wall 2' form-fits into the stepped portion of the upper wall 2, in effect forming an interlocking flange. Referring to FIG. 13, the stepped portions 10 on the left side (adjacent second peripheral joint 9) opposite first peripheral joint 4, together with second peripheral joint 9, assist in forming hinge 11 relative the opening action caused by tearing opening strip 7. Having the stepped portions 10 formed on two or more sides, preferably around the periphery, assists in retaining upper and lower walls 2, 2' in relative orientation further allows just two sides to be sealed at first and second peripheral joints 4, 9, while the top 22 and bottom 24 sides can remain unsealed, which assists the packaging unit's opening like a clamshell when opening strip 7 is separated. Therefore, when the first peripheral joint 4 located on opening strip 7 is torn away, the plastic material walls 2, 2' easily snap apart and separate about the second periphery joint 9, or hinge 11, providing rapid and trouble-free removal of the article 16 contained within the article-receiving region 3.

The interlocking stepped portions 10 help retain the orientation of upper and lower walls 2, 2' while they are held together for joining in order to seal the article there-between, thus simplifying assembly. When formed in both upper and lower walls 2, 2', interlocking stepped portions 10 along the weakened region 5 can also be loosely snapped back together after the package has been opened, encouraging disposal of the package and its informational inserts 14, 15, discussed further below, as an entire unit for possible recycling. The stepped portions 10 also prevent crushing and buckling of the plastic material walls 2, 2' when compressive loading is applied to packaging unit 1. One of skill in the art understands to choose stepped portions 10 of sufficient depth to withstand crushing given such factors as thickness and stiffness of the wall material and the packaging unit's overall length and width, the stepped portions 10 being about ten times a material thickness. It has been found suitable to have stepped portions 10 have a depth of about 0.21 inch (5.3 mm) using plastic wall material of 0.015 inch (0.4 mm) thickness.

The packaging unit 1 can further have diagonal cross-ribs 13 that provide structural support and resist crushing. FIG. 12 shows cross-ribs 13 formed on lower wall 2'; of course, cross-ribs 13 could be formed on either or both walls 2, 2'.

Figure 14:
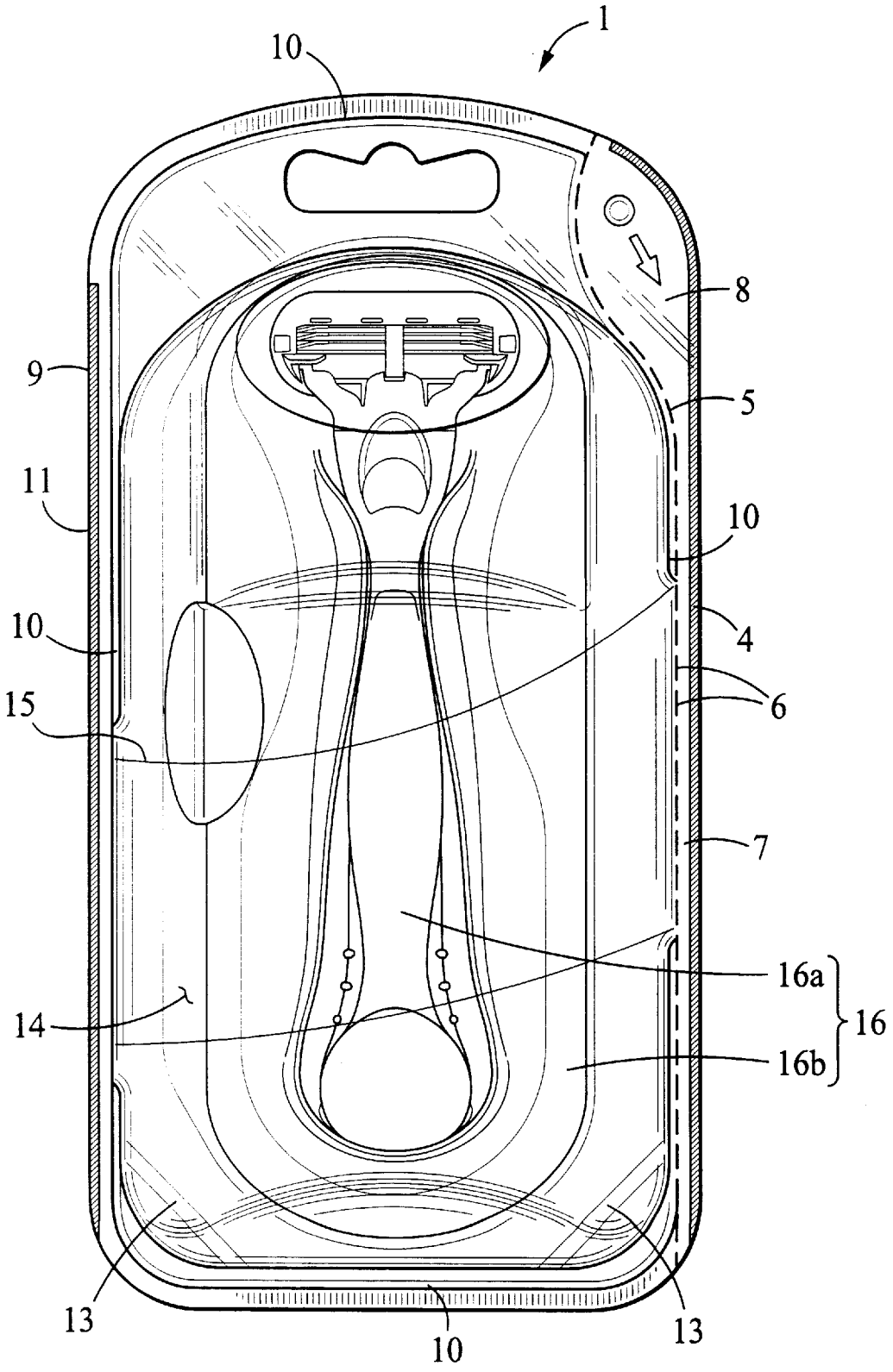
FIG. 14 shows a razor set received within the packaging unit of FIG. 7.
Figure 15:
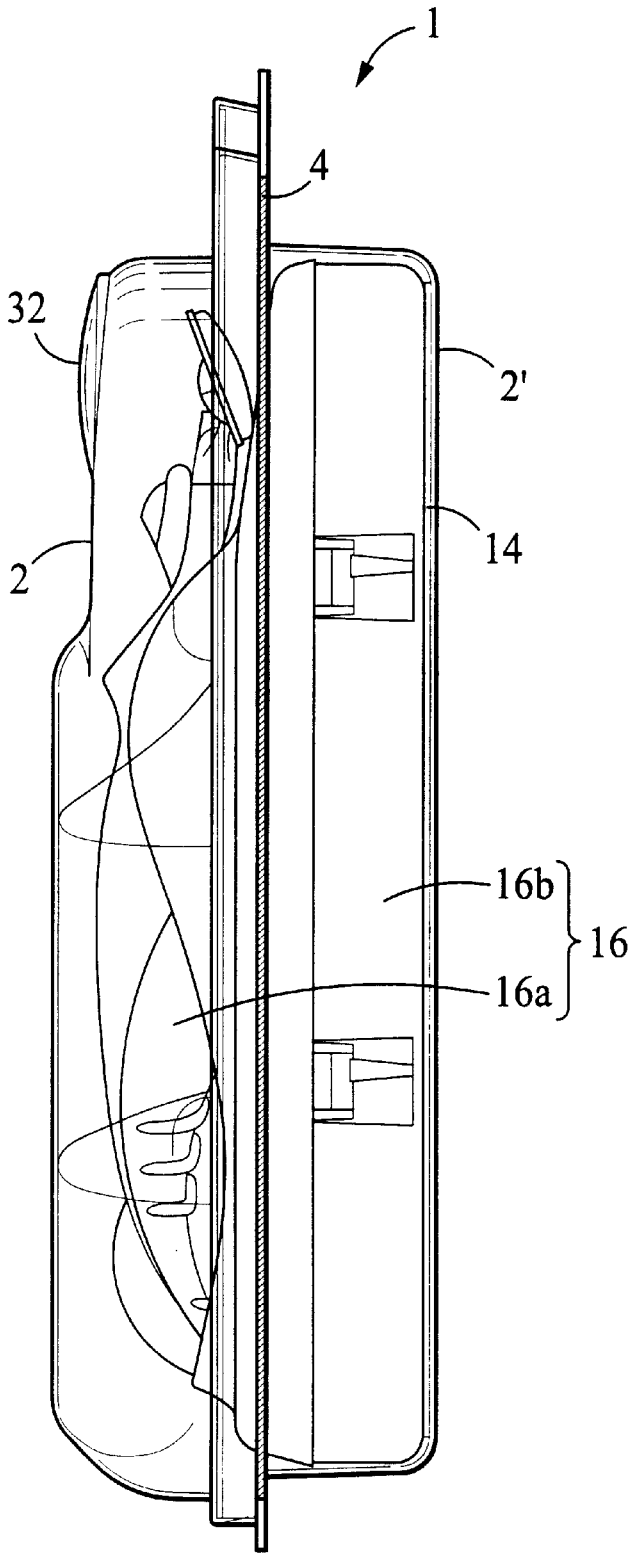
FIG. 15 shows the packaged article of FIG. 14 viewed from the side.

Referring to FIGS. 10–12, it is seen that the packaging unit 1 has a first product informational insert 14 and a second product informational insert 15 disposed within the article-receiving region 3. As shown in FIG. 15, first product informational insert 14 is disposed between the article 16 contained in the article-receiving region 3 and the lower plastic material wall 2', and may be viewed at least from the rear of the packaging unit 1, and also partially from the front as seen in FIG. 14. The second product informational insert 15 is disposed generally within the upper portion of article-receiving region 3 and at least partly overlying the article 16 contained within article-receiving region 3, and can ibe read from the front. Referring to FIGS. 10–11, it is preferred that the second product informational insert 15 is retained underneath upper wall 2 by a retaining structure 20 on upper wall 2. Retaining structure 20 can conveniently be formed as a lip, ledge or undercut into which a part, such as flat, sheet-like retained portion 15*a*, of second insert 15 can be abutted, snapped or inter-fit, as shown in FIGS. 10–11. Sheet-like portion 15*a* of second insert 15 is approximately at a plane of separation between upper and lower halves of article-receiving region 3 between upper and lower walls 2,2'. Referring to FIG. 12, retaining structure 20 prevents the second informational insert 15 from falling into the article-receiving region 3, and inhibiting access to the article 16 contained within, when the walls 2,2' are separated upon opening of the packaging unit 1. Preferably the second informational insert comprises a cut-out portion 15*b*, for example an hourglass-shaped cut-out, that fits around the article 16, and a further portion 15*c* that arches like a banner over article 16. Informational inserts 14, 15 can be made of cardboard or plastic, but it is preferred that second informational insert 15 be made of plastic, especially transparent plastic, since it can overlie and still permit viewing article 16. All visible portions of the first and second product informational inserts 14, 15 can carry information relating to the article 16, and make efficient use of the volume within article-receiving region 3 to communicate messages to users, which is advantageous when walls 2,2' are made of transparent plastic which enhances viewing article 16 but itself is sometimes too slick a surface to be easily printed with product information. Locating information inserts 14, 15 within packaging unit 1 promotes environmentally sound disposal as a unit for recycling.

Figure 16:
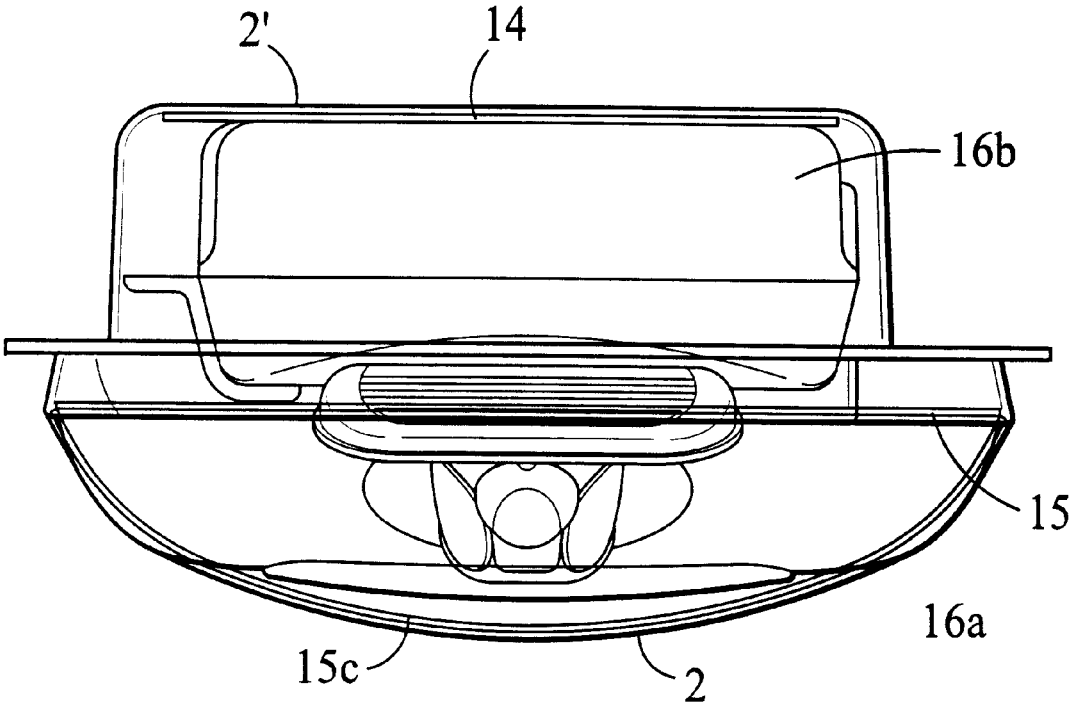
FIG. 16 shows the packaged article of FIG. 14 viewed from the top end.

Referring to FIGS. 14–16, the present invention includes the combination of semi-rigid plastic packaging unit 1 and an article 16. The article may be an article of personal use, such as a razor, a razor blade unit, a shaving unit, a shaving head, a toothbrush, a battery, an energy or other fuel cell for an electric- or gas-powered appliance, or the like. The article depicted in FIGS.14–16 is a razor set which includes a razor 16*a* and its organizer tray 16*b*. The razor handle is shown in U.S. Des. Pat. No. 407,851 (Shurtleff); the cartridge is shown in U.S. Des. Pat. No. 415,315 (Swanson et al.); and the organizer tray is shown in co-pending applications U.S. Des. Ser. No. 29/108,565 and in U.S. patent Ser. No. 09/364,240; all of which are hereby incorporated by reference and commonly assigned to the assignee of the present application.

Packaging unit 1 can also have a convex viewing window 32 formed in upper wall 2 overlying article 16 having a lens effect to enhance viewing article 16. Conveniently, part of article-receiving region 3 defined by lower wall 2' is generally form-fitting with respect to the overall envelope surface of article 16, such as a razor organizer tray 16*b*, so that is vertically dropped in during a sealing operation and oriented in place.

Other embodiments of the invention are within the scope of the claims. For example, a method for facilitating opening of a plastic packaging unit 1, whereby an article-receiving region 3 is formed between two walls 2, 2', and enclosing an article 16 within said article-receiving region 3. The walls 2,2', preferably at least one of which is formed of plastic, being sealed at a peripheral joint 4; weakening a region 5 inward of said peripheral joint 4; subsequently tearing the sealed packaging unit 1 at the weakened region 5 with a manual force, detaching at least partially the weakened region 5 from the packaging unit 1, and separating the walls 2, 2' to access the article 16 within the article-receiving region 3. The weakening step can include weakening one of the walls, or preferably both. The weakening step can be performed subsequent to the step of sealing, or can be performed prior to the step of sealing. Both walls can be made of plastic. Stepped portions 10 can be provided to form a rib 12 helping to direct a tearing force.

In another aspect of the invention, one of the walls, preferably upper wall 2, is made of semi-rigid plastic material that has a weakened region 5, such as by scores or perforations as discussed above, and the other of the walls, such as lower wall 2', is made of a film or thin sheet, preferably flexible, that generally does not withstand tearing and thus does not require its own specific weakened region. Thus lower wall 2' is inherently weak enough (in the sense of not being tear-resistant) in the region near to the relatively more rigid upper 2 wall's weakened region 5 so that the opening strip 7 defined adjacent peripheral joint 4 can be torn upon application of a manual force by a user and yet tears both plies so as to separate the peripheral joint 4 from the remainder of the packaging unit, as has generally been described above. This structure is an additional way of economically forming one of the walls, such as the lower wall, as a flat, light-weight film. In this embodiment it can be helpful to provide stepped portion 10 on one of the walls, preferably at least on upper wall 2, or even on both walls 2,2' in the form of interlocking stepped portions, to provide a rib helping to direct the manual tearing force.

Modifications and changes can be made within the spirit and scope of the present invention, which is intended, however, only to be limited by the appended claims.

Without limiting the scope of the invention, reference numerals used herein are listed:

1 packaging unit
2 upper wall
2' lower wall
3 article-receiving region
4 first peripheral joint
5 weakened region
6 perforations
7 opening strip
8 gripping corner
9 second peripheral joint
10 stepped portion
11 hinge
12 rib
13 cross-rib
14 first information insert
15 second information insert
15*a* sheet portion
15*b* cut-out portion
15*c* arch portion
16 packaged article
16*a* razor
16*b* organizer tray
20 retaining lip
22 top edge
24 bottom edge
26 thumb indentation
28 arrow indicia
30 location indicia
32 viewing window

What is claimed is:

1. A packaging unit comprising:

two spaced-apart upper and lower walls formed to define an article-receiving region between them, at least a first of said walls being formed of semi-rigid plastic material, said walls being sealed together at a first peripheral joint, and said walls having along, and inward of, said peripheral joint, a weakened region formed in both said walls, said walls being hermetically unsealed in a laterally inward region between said weakened region and said article-receiving region, said weakened region extending along a sufficient extent of the perimeter of said packaging unit and said weakened region is rupturable by a user to separate said peripheral joint from said upper and lower walls and thereupon the upper wall, in a region along a first portion of the perimeter of the packaging unit extending along the ruptured peripheral joint and along second portion of the perimeter of the packaging unit extending at least partially transverse to the first portion, is readily separable away from the underlying lower wall upon application of a manual forece in order to access said article-receiving region.

2. The packaging unit of claim 1, wherein the upper and lower walls are formed of semi-rigid material.

3. The packaging unit of claim 1, wherein the upper and lower walls are of plastic.

4. The packaging unit of claim 1, wherein a second of said walls is cardboard.

5. The packaging unit of claim 1, wherein said weakened region extends toward at least one edge of said packaging unit.

6. The packaging unit of claim 1, wherein said weakened region comprises perforations.

7. The packaging unit of claim 1, wherein said first peripheral joint comprises a heat-sealed seam.

8. The packaging unit of claim 1, wherein said first peripheral joint comprises a radio frequency sealed seam.

9. The packaging unit of claim 1, further comprising inward of said first peripheral joint, interlocking stepped portions formed in said walls.

10. The packaging unit of claim 1, further comprising a stepped portion formed in at least one said wall and disposed along a marginal edge of the packaging unit opposite said first peripheral joint, thereby forming a hinge to facilitate opening of said upper and lower walls from one another.

11. The packaging unit of claim 10, wherein the packaging unit has a generally rectangular footprint, the first peripheral joint and the stepped portion being disposed on laterally opposite sides.

12. The packaging unit of claim 1, further comprising, inward of said first peripheral joint, at least one stepped portion formed in one of said walls, and wherein the weakened region is disposed between the first peripheral joint and the stepped portion, said stepped portion forming a rib along which an application of a tearing force is directed.

13. The packaging unit of claim 1, wherein said weakened region is approximately coextensive with an extent of said first peripheral joint.

14. The packaging unit of claim 1, further comprising a second peripheral joint on a side of said article-receiving region other than a side containing the first peripheral joint.

15. The packaging unit of claim 14, wherein said second peripheral joint forms a hinge about which said walls separate when the weakened region is torn away.

16. The packaging unit of claim 1, wherein said weakened region extends adjacent the first peripheral joint towards an adjacent marginal side of the packaging unit, thereby forming a gripping corner for the application of a tearing force.

17. The packaging unit of claim 16, wherein said gripping corner is provided with tear indicia.

18. The packaging unit of claim 16, wherein said gripping corner has an inwardly directed curve shape forming a thumb indentation for manipulation.

19. The packaging unit of claim 16, wherein said gripping corner is located at an approximate intersection of two adjacent marginal sides of the packaging unit.

20. The packaging unit of claim 1, further comprising lower and upper product informational inserts disposed at spaced-apart respective locations within said article-receiving region.

21. The packaging unit of claim 20, wherein said lower product informational insert is disposed between a received article and the bottom wall.

22. The packaging unit of claim 20, wherein said upper product informational insert is under said upper wall at least partially overlying said article-receiving region.

23. The packaging unit of claim 22, wherein said upper wall comprises retaining structure inhibiting said upper product informational insert from blocking the article-receiving region when the upper and lower walls are separated.

24. The packaging unit of claim 20, wherein said upper product informational insert comprises a cut-out portion to fit around a received article and an arch portion extending over said article-receiving region.

25. The packaging unit of claim 24, wherein said portions carry product information to be read from the front of the packaging unit.

26. The packaging unit of claim 1 in combination with an article received within said article-receiving region.

27. The packaging unit and article combination of claim 26, wherein said article is an article of personal use.

28. The packaging unit and article combination of claim 27, wherein said article of personal use is chosen from a group of articles consisting of a razor, a shaving blade unit, a shaving head, a toothbrush, a battery, and an energy cell.

29. The packaging unit of claim 1, wherein the upper and lower walls are unsealed to one another along at least one portion along the periphery adjacent the weakened region.

30. The packaging unit of claim 1, wherein the upper and lower walls are unsealed to one another on opposite lateral edges of the packaging unit, each said unsealed lateral edge being adjacent the edge having the first peripheral joint.

31. The packaging unit of claim 1, wherein the packaging unit is generally rectangular in plan view having first and second pairs of laterally opposite sides, the first peripheral joint extending along one said marginal side of one of said pairs of sides, and said upper and lower walls being unsealed along opposite sides of said other pair.

32. The packaging unit of claim 1, wherein the weakened region is rupturable by a user upon application of a second manual force, said manual force to separate the upper and lower walls away from one another not exceeding said second manual force.

33. The packaging unit of claim 1, wherein upon rupture of the weakened region a portion not less than half of the perimeter of the packaging unit becomes unsealed.

34. The packaging unit of claim 1, wherein the weakened region is substantially coextensive with the perimeter of the packaging unit.

35. The packaging unit of claim 14, wherein the side having said second peripheral joint is opposite the first peripheral joint.

36. A method for facilitating opening a packaging unit, comprising the steps of:

forming an article-receiving region between upper and lower walls, at least a first of said walls being formed of plastic material, enclosing an article within said article-receiving region, sealing said walls at a peripheral joint, weaking a region of the packaging unit inward of said peripheral joint along a sufficient extent of the perimeter of said packaging unit, leaving said walls hermetically unsealed in a laterally inward region between said weakened region and said article-receiving region, subsequently tearing the upper and lower walls of the sealed packaging unit at the weakened region with a manual force, detaching at least partially said weakened region and said peripheral joint from the packaging unit along said sufficient extent of the perimeter, and readily separating with a force not exceeding said manual force said upper wall away from said lower wall along at least two generally mutually transversely lying portions of the perimeter of the packaging unit to thereby access said article within said article-receiving region.

37. The method of claim 36, wherein said step of weakening is performed subsequent to the step of sealing.

38. The method of claim 36, wherein said step of weakening is performed prior to the step of sealing.

39. The method of claim 36, wherein said step of forming further comprises forming both walls of semi-rigid material.

40. The method of claim 36, wherein said step of forming further comprises forming both walls of plastic material.

41. The method of claim 36, wherein said step of forming further includes forming a rib in the packaging unit, and further comprising the step of directing the manual tearing force along the rib.

42. The method of claim 36, wherein said step of weakening forms the weakened region in both walls.

43. A packaging unit comprising:

two spaced-apart upper and lower walls formed to define an article-receiving region between them, said walls being sealed together at a first peripherl joint, at least a first of said walls being formed of semi-rigid plastic material, a weakened region formed in said first of said walls along, and inward of, said peripheral joint and outward of said article-receiving region, a second of said walls being, in a region adjacent said weakened region of said first wall, tearable upon application of a manual force, and an opening strip being defined in a portion of said upper and lower walls disposed between said peripheral joining and said weakened region and said region adjacent said weakened region, said walls being hermetically unsealed in a laterally inward region between said opening strip and said article-receiving region, said weakened region extending along a sufficient extent of the perimeter of the packaging unit and that said weakened region and said adjacent second wall region are together rupturable by a user exerting manual force on said opening strip in order to separate said peripheral joint from said upper and lower walls of the remaining packaging unit and thereupon said remaining upper wall being readily separable from said underlying remaining lower wall in order to access said article-receiving region.

44. The packaging unit of claim 43, wherein said weakened region comprises perforations.

45. The packaging unit of claim 43, wherein said second of said walls is formed of flexible film.

46. The packaging unit of claim 43, wherein said second of said walls is formed of semi-rigid plastic material and having said adjacent tearable region being formed by a weakened region formed in said second of said walls.

47. The packaging unit of claim 46, wherein said second wall weakened region comprises perforations.

48. The packaging unit of claim 43, wherein a stepped portion is formed on at least one said wall forming a rib.

49. A method for facilitating opening a packaging unit, comprising the steps of:

forming an article-receiving region between upper and lower walls, at least a first of said walls being formed of plastic material, enclosing an article within said article-receiving region, sealing said walls at a peripheral joint, weakening a region of the packaging unit inward of said peripheral joint, leaving said walls hermetically unsealed in a laterally inward region between said weakened region and said article-receiving region, subsequently tearing the upper and lower walls of the sealed packaging unit at the weakened region with a manual force, detaching at least partially said weakened region and said peripheral joint from the packaging unit, and separating, in response to said step of detaching said weakened region, said upper wall away from said lower wall to thereby access said article within said article-receiving region.

50. The packaging unit of claim 49, wherein the step of forming further includes forming a hinge along mating portions of said upper and lower walls at a side of said article-receiving region spaced from a side containing the peripheral joint, and the step of separating further includes separating the upper wall from the lower wall about said hinge.

51. A packaging unit, comprising:

two spaced-apart upper and lower walls formed to define an article-receiving region between them, at least a first of said walls being formed of semi-rigid plastic material, said walls being sealed together at a first peripheral joint, and said walls having along, and inward of, said peripheral joint, a weakened region formed in both said walls, said weakened region being located outside of said article receiving region, said walls being hermetically unsealed in a region laterally inward of said weakened region and outward of said article-receiving region, whereby said weakened region is rupturable by a user to separate said peripheral joint from said upper and lower walls to access said article-receiving region.

52. The packaging unit of claim 51, wherein mating portions of said upper and lower walls, at a side of said article-receiving region spaced from a side containing the first peripheral joint, define a hinge about which said walls are separable when the weakened region is torn away.

53. A packaging unit comprising:

two spaced-apart upper and lower walls formed to define an article-receiving region between them for removably containing an article therein, said walls being sealed together at a first peripheral joint, at least a first of said walls being formed of semi-rigid plastic material, a weakened region formed in said first of said walls along, and inward of; said peripheral joint, a second of said walls being, in a region adjacent said weakened region of said first wall, tearable upon application of a manual force, and an opening strip being defined in a portion of said upper and lower walls disposed between said peripheral joint and said weakened region and said region adjacent said weakened region, said walls being hermetically unsealed in a laterally inward region between said opening strip and said article-receiving region, whereby said weakened region and said adjacent second wall region are together rupturable by a user exerting force on said opening strip in order to separate said peripheral joint from said upper and lower walls and from said article-receiving region to access said article-receiving region, said article-receiving region being removable from the received article.

54. The packaging unit of claim 53, wherein mating portions of said upper and lower walls, at a side of said article-receiving region spaced from a side containing the first peripheral joint, define a hinge about which said walls are separable when the weakened region is torn away.

55. A packaging unit containing an article, comprising:

two spaced-apart upper and lower walls formed to define an article-receiving region between them, an article removably disposed within said article-receiving region, said walls being sealed together at a first peripheral joint, at least a first of said walls being formed of semi-rigid plastic material, a weakened region formed in said first of said walls along, and inward of, said peripheral joint, a second of said walls being, in a region adjacent said weakened region of said first wall, tearable upon application of a manual force, and an opening strip being defined in a portion of said upper and lower wails disposed between said peripheral joint and said weakened region and said region adjacent said weakened region, said walls being hermetically unsealed in a laterally inward region between said opening strip and said article-receiving region, whereby said weakened region and said adjacent second wall region are together rupturable by a user exerting force on said opening strip in order to separate said peripheral joint from said upper and lower walls and from said article to access said article-receiving region, whereby said article is removable away from the article-receiving region.

56. The combination packaging unit and article of claim 55, wherein mating portions of said upper and lower walls, at a side of said article-receiving region spaced from a side containing the first peripheral joint, define a hinge about which said walls are separable when the weakened region is torn away.

* * * * *